US011767699B2

(12) United States Patent
Nilsson et al.

(10) Patent No.: US 11,767,699 B2
(45) Date of Patent: Sep. 26, 2023

(54) ANTI FINGER PINCH

(71) Applicant: Ningbo Geely Automobile Research & Development Co., Ltd., Ningbo (CN)

(72) Inventors: Magnus Nilsson, Floda (SE); Måns Pihlsgård, Gothenburg (SE)

(73) Assignee: Ningbo Geely Automobile Research & Development Co., Ningbo (CN)

( * ) Notice: Subject to any disclaimer, the term of this patent is extended or adjusted under 35 U.S.C. 154(b) by 54 days.

(21) Appl. No.: 17/357,801

(22) Filed: Jun. 24, 2021

(65) Prior Publication Data

US 2021/0317694 A1 Oct. 14, 2021

Related U.S. Application Data

(63) Continuation of application No. PCT/CN2019/124456, filed on Dec. 11, 2019.

(30) Foreign Application Priority Data

Jan. 15, 2019 (EP) ..... 19151770

(51) Int. Cl.
*E05F 15/46* (2015.01)
*E05F 15/41* (2015.01)

(52) U.S. Cl.
CPC ..... *E05F 15/46* (2015.01); *E05F 15/41* (2015.01); *E05Y 2400/20* (2013.01); *E05Y 2400/56* (2013.01); *E05Y 2900/532* (2013.01)

(58) Field of Classification Search
CPC ..... E05F 15/46; E05F 15/41; E05F 15/40; E05Y 2400/54
See application file for complete search history.

(56) References Cited

U.S. PATENT DOCUMENTS 8,205,498 B2 * 6/2012 Hsu ..... G01P 15/125 73/514.32
8,245,447 B2 * 8/2012 Oh ..... E05C 17/60 49/164
9,777,528 B2 * 10/2017 Elie ..... E05F 15/41
2002/0093420 A1 7/2002 Sicuranza
(Continued)

FOREIGN PATENT DOCUMENTS

CN 102071860 A 5/2011
CN 106394204 A 2/2017
(Continued)

OTHER PUBLICATIONS

International Search Report from corresponding International Application No. PCT/CN2019/124456, dated Mar. 11, 2020, 3 pages.

*Primary Examiner* — Janet M Wilkens
*Assistant Examiner* — Susan M. Heschel
(74) *Attorney, Agent, or Firm* — TUCKER ELLIS LLP

(57) ABSTRACT

A system for avoiding pinching in vehicle doors includes capacitive proximity sensors for being mounted at each door along closing surfaces. The system also includes an accelerometer for being arranged in each door, a stopper bar, and a release mechanism for the stopper bar. The capacitive proximity sensors, the accelerometer, and the release mechanism are connected to a control unit arranged such that the stopper bar is moved to a blocking position when the capacitive proximity sensor for the same door senses an object and the door has stopped accelerating.

14 Claims, 3 Drawing Sheets

(56) References Cited

U.S. PATENT DOCUMENTS

| | | | | |
|---|---|---|---|---|
| 2018/0038146 | A1* | 2/2018 | Linden | E05F 15/611 |
| 2018/0058128 | A1* | 3/2018 | Khan | E05F 15/42 |

FOREIGN PATENT DOCUMENTS

| | | | |
|---|---|---|---|
| CN | 206256801 | U | 6/2017 |
| CN | 108118987 | A | 6/2018 |
| DE | 102008003643 | A1 | 7/2009 |
| DE | 102016212447 | A1 | 1/2018 |
| JP | 2006283412 | A | 10/2006 |
| JP | 2013086665 | A | 5/2013 |

* cited by examiner

ANTI FINGER PINCH

RELATED APPLICATION DATA

This application is a continuation of International Patent Application No. PCT/CN2019/124456, filed Dec. 11, 2019, which claims the benefit of European Patent Application No. 19151770.5, filed Jan. 15, 2019, the disclosures of which are incorporated herein by reference in their entireties.

TECHNICAL FIELD

The present invention relates to a system for avoiding pinching in vehicle doors comprising capacitive proximity sensors for being mounted at each door along the closing surfaces.

BACKGROUND

Anti-pinch technology is a safety system which modern vehicles employ in power windows. The power window is the window which uses an electric motor to operate. As the name suggests, this technology prevents the winding up of the power window if an accident could occur. If the system senses any obstacle in the path of the glass, it prevents the window glass from moving further up. Thus, it prevents possible injuries to the occupants.

Power windows are basically standard in all passenger cars today, even for budget vehicles. With the growing popularity of power windows focus towards safety was increasing due to severe "pinching". Especially children playing with the windows are subject to pinching incidents. The risk also arises in case of power windows which are programmed to operate without even the need to press the switch. Thus, in order to avoid such mishaps, engineers invented the anti-pinch technology.

Hence, in the case of a power window equipped with anti-pinch technology, the electric motor is fitted with a sensor which can sense the resistive force acting against the motion of the glass. As soon as the motor detects the obstacle, the winding action stops immediately and it starts operating in reverse direction. As a result, the window comes down; avoiding any injury to the occupant. In many countries around the world, it is mandatory to use of anti-pinch technology.

A similar anti-pinch technology is used for power doors, the most common type being sliding doors of multi-purpose vehicles (MPVs). However, there are anti-pinch systems available also for power doors hinged in a regular way, i.e. that opens by one side swinging away from the vehicle.

SUMMARY

It is an object of the present disclosure to provide an anti-pinch system for vehicle doors that are opened and closed manually.

According to a first aspect of the present disclosure, a system for avoiding pinching in vehicle doors, comprising capacitive proximity sensors for being mounted at each door along the closing surfaces is provided. The system further comprises an accelerometer for being arranged in each door, a stopper bar, and a release mechanism for the stopper bar, the capacitive proximity sensors, the accelerometer, and the release mechanism being connected to a control unit arranged such that the stopper bar is moved to a blocking position when the capacitive proximity sensor for the same door senses an object and the door has stopped accelerating.

Generally, when a door is being closed, the major part of the acceleration happens almost immediately. Thus, in the context of the present disclosure, "stopped accelerating" should be interpreted to comprise small changes in the speed. Typically, a minimum threshold is set for changes in speed. This could be achieved by choosing an accelerometer that is not sensitive to small changes in speed, i.e. not sensitive to low accelerations.

The door not accelerating anymore indicates that no force is applied to the door, i.e. the door is not pulled or pushed towards the closed position but released and is moving at a more or less constant speed. If at this point there is a hand or finger/s anywhere along the closing surfaces it does most likely not belong to the person closing the door. Also, if an object, i.e. some kind of device, is in a position anywhere along the closing surfaces, the stopper bar is arranged to stop the door, thus saving the device itself, the door or both depending of course on what kind of a device that is detected by the capacitive proximity sensor.

The accelerometer is according to one aspect of the present disclosure a capacitive accelerometer. Optionally, the accelerometer could be combined with the capacitive proximity sensor.

According to a further aspect of the present disclosure, the stopper bar is at one end pivotally arranged such that it swings in an arc when moving between a non-triggered and triggered position. In a triggered position, the pivotal arrangement means that the door itself cannot push the stopper bar back into the non-triggered position. In other words, the stopper bar cannot by mistake be pushed back into the non-triggered position. In order to bring the stopper bar back into the non-triggered position after it has been triggered it thus has to be folded or swung back.

The stopper bar is spring loaded according to another aspect of the present disclosure. In a non-triggered position, a spring acts with a force to move the stopper bar to the triggered position and in the non-triggered position the stopper bar is held in position by a latch that is controlled by the control unit via the release mechanism.

According to an alternative aspect of the present disclosure, the stopper bar is held in the non-triggered position by a solenoid. As an alternative to a latch or in combination with a latch, the stopper bar is activated or released utilizing a solenoid.

According to an aspect of the present disclosure, a spring loaded elongate bar is arranged relative the pivotally arranged stopper bar such that when the spring loaded bar is released it moves longitudinally towards a point on the stopper bar at a distance from said end of the stopper bar such that the stopper bar moves to the triggered position. The spring loaded elongate bar is arranged more or less perpendicular to the stopper bar when the stopper bar is in the non-triggered position. To get the stopper bar into the triggered position the spring loaded elongate bar moves in a longitudinal direction towards a point on the stopper bar at a distance from the pivot point of the stopper bar. Thus, upon further movement of the spring loaded elongate bar, the stopper bar is forced to rotate about 90 degrees around the pivot point. In the triggered position, the spring loaded elongate bar and the stopper bar end up parallel to one another.

The spring loaded elongate bar is according to a further aspect of the present disclosure held in the non-triggered position by a solenoid.

According to yet another aspect of the present disclosure the capacitive proximity sensors are arranged on the vehicle body along the closing surfaces for the doors.

According to an alternative aspect of the present disclosure the capacitive proximity sensors are arranged on the vehicle doors along the closing surfaces.

The stopper bars are according to an aspect of the present disclosure arranged in the doors.

According to an alternative aspect of the present disclosure the stopper bars are arranged on the vehicle body.

According to one aspect of the present disclosure a method for preventing a vehicle door from pinching along the closing surfaces of a door is provided. The vehicle comprises a capacitive proximity sensor arranged at each door along the closing surfaces, an accelerometer arranged in each door, and a stopper bar arranged at each door such that when activated it prevents the door from closing entirely. The method comprises detecting if a door is in an open position, measuring a capacitance of a field extending through the aperture of said door using the capacitive proximity sensor when the door is open, generating a signal from the capacitive proximity sensor based on the capacitance measurements, monitoring the signal from the accelerometer, and activating the stopper bar if the door after accelerating stops accelerating and the signal from the capacitive proximity sensor indicates that an object is detected in the aperture anywhere along the closing surfaces.

Further features of, and advantages with, the present invention will become apparent when studying the appended claims and the following description. The skilled person realize that different features of the present invention may be combined to create embodiments other than those described in the following, without departing from the scope of the present invention.

BRIEF DESCRIPTION OF THE DRAWINGS

The above, as well as additional objects, features and advantages of the present invention, will be better understood through the following illustrative and non-limiting detailed description of exemplary embodiments of the present invention, wherein.

DETAILED DESCRIPTION

Figure 1:
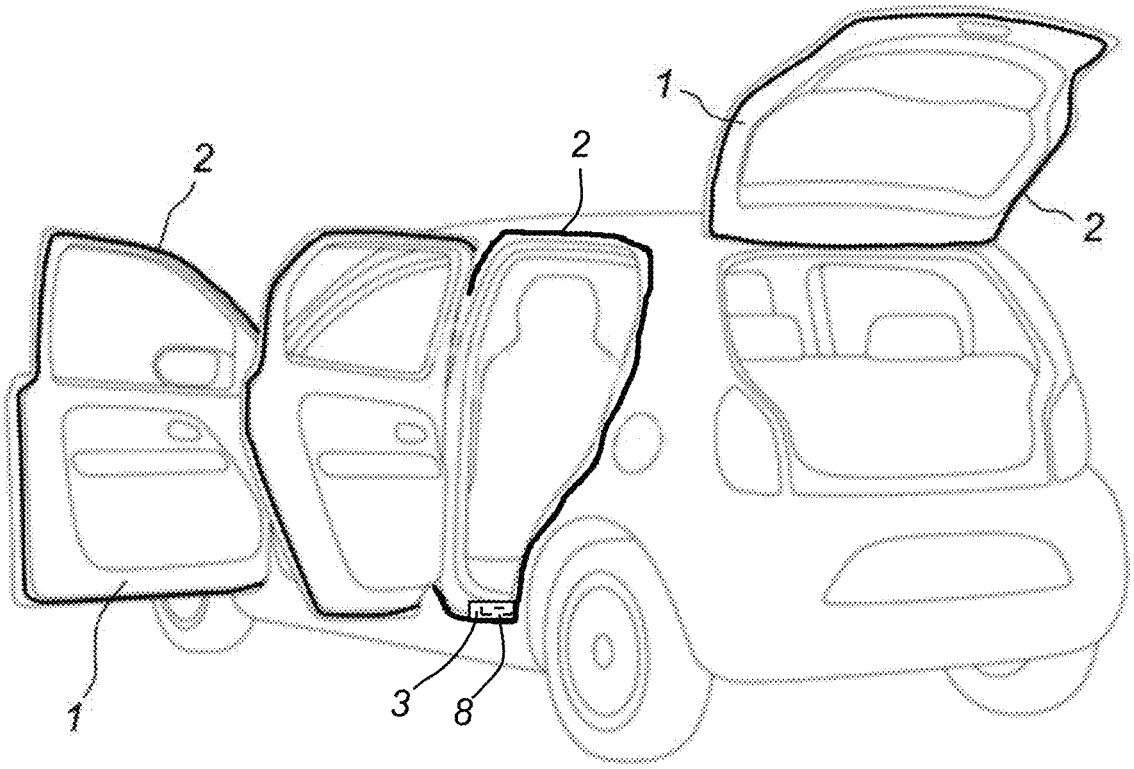
FIG. 1 is a perspective of a vehicle with open doors.

The present invention will now be described more fully hereinafter with reference to the accompanying drawings, in which exemplary embodiments of the invention are shown. The invention may, however, be embodied in many different forms and should not be construed as limited to the embodiments set forth herein; rather, these embodiments are provided for thoroughness and completeness. Like reference character refer to like elements throughout the description.

With reference to FIG. 1 a vehicle is shown having a system for avoiding pinching in the doors 1. The doors each comprise capacitive proximity sensors 2 along the closing surfaces. The capacitive proximity sensors 2 are arranged on the vehicle doors 1 along the closing surfaces or on the vehicle body along the closing surfaces for the doors.

Figure 2:
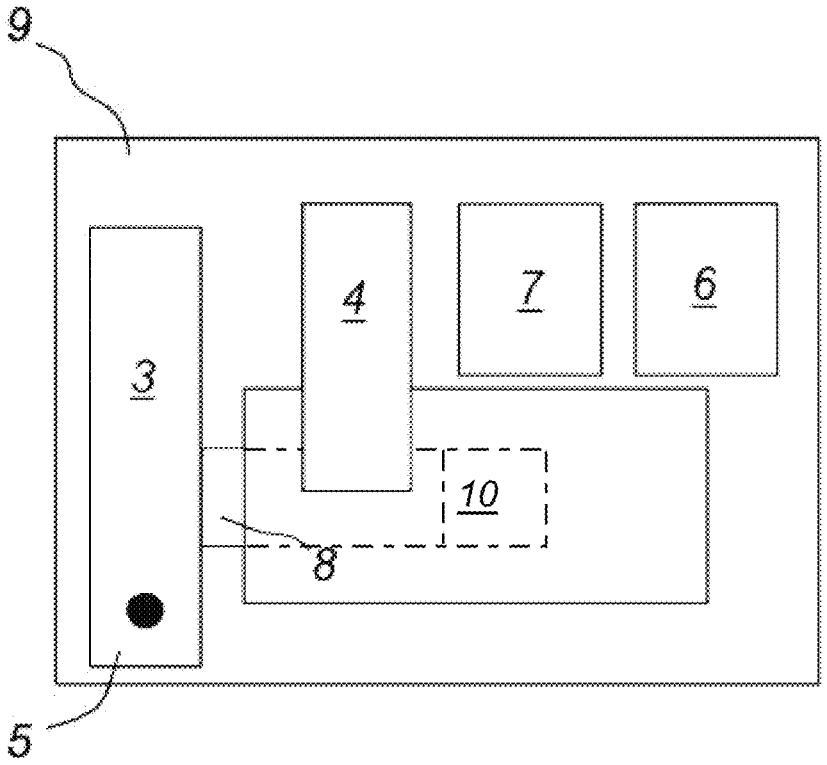
FIG. 2 is a schematic view of a stopper bar mechanism according to an embodiment of the present disclosure in a non-triggered position.
Figure 3:
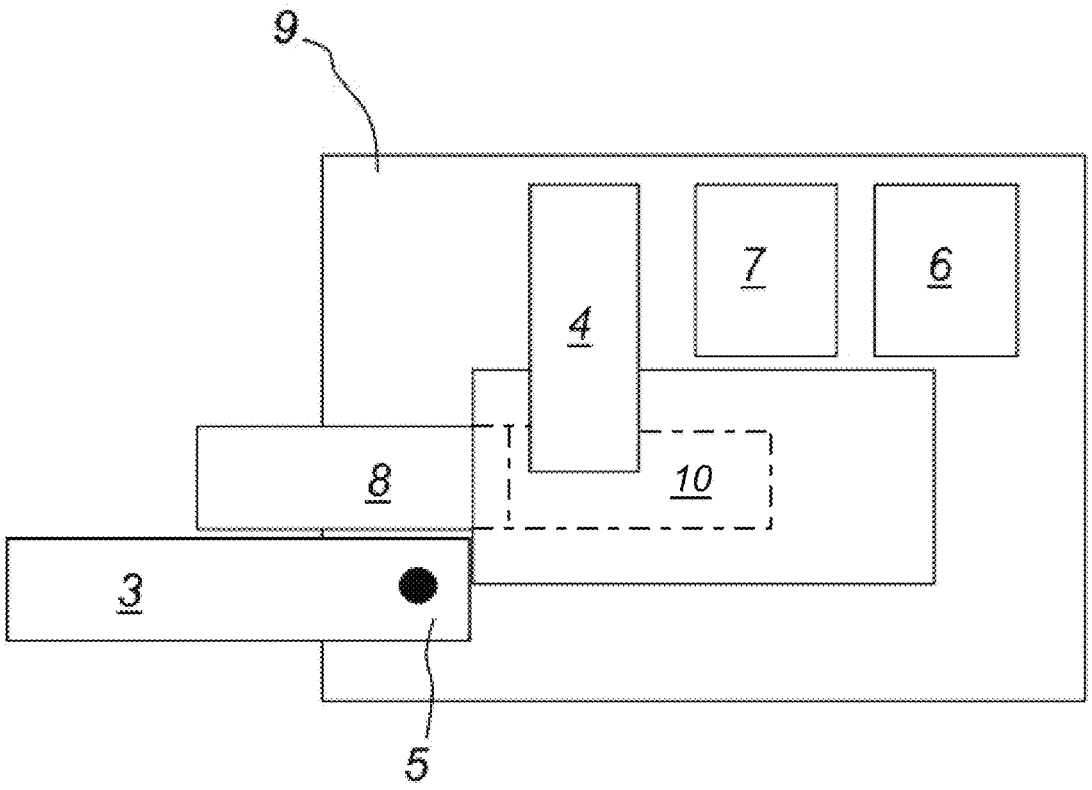
FIG. 3 is a schematic view of a stopper bar mechanism according to an embodiment of the present disclosure in a triggered position.

Turning to FIGS. 2 and 3, in the shown embodiment the system further comprises an anti-pinching unit 9, the anti-pinching unit 9 comprises an accelerometer 6, a stopper bar 3, and a release mechanism 4 for the stopper bar 3. The capacitive proximity sensors 2, the accelerometer 6, and the release mechanism 4 are connected to a control unit 7 arranged such that the stopper bar 3 is moved to a blocking position when the capacitive proximity sensor 2 for a door senses an object and the door 1 has stopped accelerating.

The stopper bar 3 is at one end 5 pivotally arranged such that it swings in an arc when moving between a non-triggered, FIG. 2, and triggered position, FIG. 3.

Also, in the shown embodiment of FIGS. 2 and 3 a spring 10 loaded elongate bar 8 is arranged relative the stopper bar 3 such that when the spring loaded elongate bar 8 is released it moves longitudinally towards a point on the stopper bar 3 at a distance from said end 5 of the stopper bar 3 such that the stopper bar 3 moves to the triggered position. The spring loaded elongate bar 8 is held in the non-triggered position by a solenoid 4, i.e. the release mechanism is in the shown embodiment a solenoid.

Figure 4:
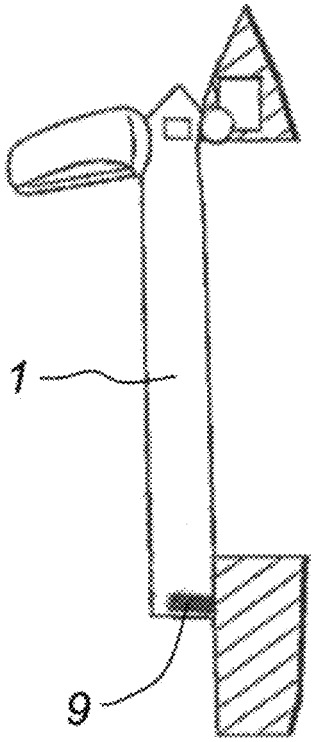
FIG. 4 is a schematic top view of a vehicle door, in part cross-sectional, in a closed position.
Figure 5:
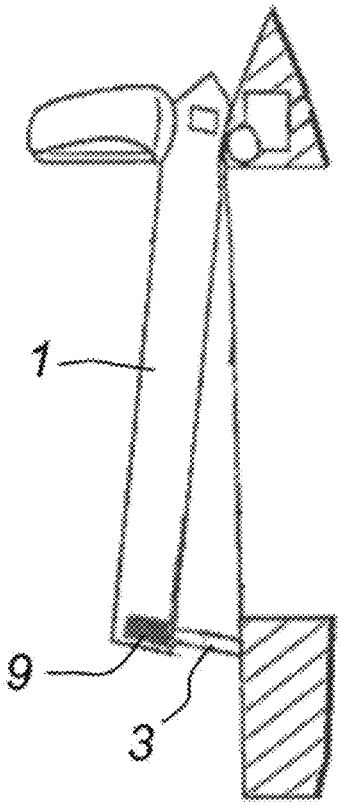
FIG. 5 is a schematic top view of a vehicle door, in part cross-sectional, in a position where the stopper bar has been activated.
Figure 6:
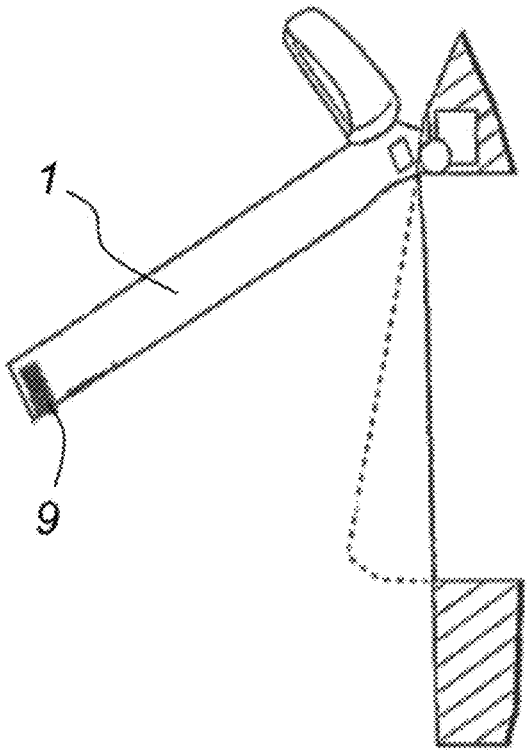
FIG. 6 is a schematic top view of a vehicle door, in part cross-sectional, in an open position.

As can be seen in FIGS. 4-6 the stopper bars 3 are arranged in the doors 1 and arranged in anti-pinching units 9 as schematically shown in FIGS. 2 and 3. As can be seen in FIG. 1, the stopper bars 3 may be arranged on the vehicle body.

The method of the anti-pinching system according to the present disclosure is such that capacitive proximity sensors 2 arranged at each door 1 along the closing surfaces together with an accelerometer 6. A stopper bar 3 is arranged at each door 1 such that when activated it prevents the door 1 from closing entirely, see FIG. 5.

When a vehicle door is closed manually from the outside it is pushed. When being pushed, the door initially accelerates until it reaches the desired speed. The acceleration is generally relatively fast. The desired speed usually corresponds at least to the minimum required for closing a vehicle door. When closed from the outside, the door is most often also released prior to being closed completely, i.e. the acceleration is definitely stopped when released.

If the vehicle door is closed from the inside of the vehicle it is pulled using a handle on the inside of the door. When the vehicle door 1 is being pulled, the maximum speed is reached relatively fast, i.e. the acceleration is most times immediate. However, since the "hand" pulling the door is moving back to the person pulling it, the hand remains on the handle until the door is closed.

Thus, the method of the present disclosure detects if a door 1 is in an open position. If open, the capacitance of a field extending through the aperture of said door is measured using the capacitive proximity sensor 2. When the door is open, a signal from the capacitive proximity sensor 2 based on the capacitance measurements is generated. At the same time, the signal from the accelerometer 6 is monitored. The stopper bar 3 is activated if the door 1 is open, if the door 1 after accelerating stops accelerating and the signal from the capacitive proximity sensor 2 indicates that an object is detected in the aperture anywhere along the closing surfaces.

It is to be understood that the present invention is not limited to the embodiments described above and illustrated in the drawings; rather, the skilled person will recognize that many changes and modifications may be made within the scope of the appended claims. For example, the accelerometer could be any type chosen from the following group:

bulk micromachined capacitive, bulk micromachined piezoelectric resistive, capacitive spring mass system base, electromechanical servo (Servo Force Balance), laser accelerometer, magnetic induction, modally tuned impact hammers, null-balance, optical, pendulous integrating gyroscopic accelerometer (PIGA), piezoelectric accelerometer, Quantum (rubidium atom cloud, laser cooled), resonance, seat pad accelerometers, shear mode accelerometer, strain gauge, surface acoustic wave (SAW), surface micromachined capacitive (MEMS), thermal (submicrometre CMOS process), triaxial, vacuum diode with flexible anode, potentiometric type, and LVDT type accelerometer.

What is claimed is:

1. A system for avoiding pinching between a door and a vehicle body, the system comprising:

a capacitive proximity sensor mounted at a periphery of the door or at a periphery of an aperture in the vehicle body for the door, an accelerometer arranged in the door, and a stopper bar and a release mechanism for the stopper bar arranged on the door, the stopper bar having a longitudinal axis extending from a proximal end of the stopper bar to a distal end of the stopper bar, the stopper bar pivotable at the proximal end so that the stopper bar is moveable from an unactivated position that allows the door to close entirely to a blocking position that prevents the door from closing entirely, and wherein the release mechanism for the stopper bar comprises an elongate bar that has a longitudinal axis extending from an engagement end of the elongate bar to an opposite end of the elongate bar, wherein:

in the unactivated position, the engagement end of the elongate bar is adjacent a side of the stopper bar between the proximal and distal ends of the stopper bar so that the longitudinal axis of the stopper bar and the elongate bar are perpendicular; and to move the stopper bar from the unactivated position to the blocking position, the engagement end of the elongate bar is longitudinally moved toward the stopper bar to pivot the stopper bar so that the longitudinal axes of the elongate bar and the stopper bar are parallel, wherein the capacitive proximity sensor, the accelerometer, and the release mechanism are connected to a control unit arranged to move the stopper bar from the unactivated position to the blocking position upon detection that an output signal from the capacitive proximity sensor indicates presence of an object and an output signal from the accelerometer indicates that the door has stopped accelerating relative to the vehicle.

2. The system according to claim 1, wherein the accelerometer is a capacitive accelerometer.

3. The system according to claim 1, wherein the stopper bar swings in an arc when moving between the unactivated position to the blocking position.

4. The system according to claim 1, wherein the elongate bar is spring loaded.

5. The system according to claim 4, wherein the elongate bar is held in the unactivated position by a solenoid.

6. A vehicle with a system according to claim 1, wherein the capacitive proximity sensors are arranged on the vehicle body.

7. A vehicle with a system according to claim 1, wherein the capacitive proximity sensors are arranged on the vehicle doors.

8. A system for avoiding pinching between a door and a vehicle body, the system comprising:

a capacitive proximity sensor mounted at a periphery of the door or at a periphery of an aperture in the vehicle body for the door, an accelerometer arranged in the door, and a stopper bar and a release mechanism for the stopper bar arranged on the vehicle body, the stopper bar having a longitudinal axis extending from a proximal end of the stopper bar to a distal end of the stopper bar, the stopper bar pivotable at the proximal end so that the stopper bar is moveable from an unactivated position that allows the door to close entirely to a blocking position that prevents the door from closing entirely, and wherein the release mechanism for the stopper bar comprises an elongate bar that has a longitudinal axis extending from an engagement end of the elongate bar to an opposite end of the elongate bar, wherein:

in the unactivated position, the engagement end of the elongate bar is adjacent a side of the stopper bar between the proximal and distal ends of the stopper bar so that the longitudinal axis of the stopper bar and the elongate bar are perpendicular; and to move the stopper bar from the unactivated position to the blocking position, the engagement end of the elongate bar is longitudinally moved toward the stopper bar to pivot the stopper bar so that the longitudinal axes of the elongate bar and the stopper bar are parallel, wherein the capacitive proximity sensor, the accelerometer, and the release mechanism are connected to a control unit arranged to move the stopper bar from the unactivated position to the blocking position upon detection that an output signal from the capacitive proximity sensor indicates presence of an object and an output signal from the accelerometer indicates that the door has stopped accelerating relative to the vehicle.

9. The system according to claim 8, wherein the accelerometer is a capacitive accelerometer.

10. The system according to claim 8, wherein the stopper bar swings in an arc when moving between the unactivated position to the blocking position.

11. The system according to claim 8, wherein the elongate bar is spring loaded.

12. The system according to claim 11, wherein the elongate bar is held in the unactivated position by a solenoid.

13. A vehicle with a system according to claim 8, wherein the capacitive proximity sensors are arranged on the vehicle body.

14. A vehicle with a system according to claim 8, wherein the capacitive proximity sensors are arranged on the vehicle doors.

* * * * *